US008636469B2

(12) United States Patent
Powers

(10) Patent No.: US 8,636,469 B2
(45) Date of Patent: Jan. 28, 2014

(54) MARINE PROPELLER WITH REVERSE THRUST CUP

(76) Inventor: Charles S. Powers, Shreveport, LA (US)

( * ) Notice: Subject to any disclaimer, the term of this patent is extended or adjusted under 35 U.S.C. 154(b) by 696 days.

(21) Appl. No.: 12/925,118

(22) Filed: Oct. 14, 2010

(65) Prior Publication Data

US 2011/0091328 A1 Apr. 21, 2011

Related U.S. Application Data

(60) Provisional application No. 61/279,082, filed on Oct. 16, 2009.

(51) Int. Cl.
*B63H 1/26* (2006.01)

(52) U.S. Cl.
USPC ..... 416/93 A; 416/228; 416/236 R; 416/235; 416/243

(58) Field of Classification Search
USPC ..... 416/228, 236 R, 235, 243, 93 A
See application file for complete search history.

(56) References Cited

U.S. PATENT DOCUMENTS

| | | | | |
|---|---|---|---|---|
| 746,007 | A | 12/1903 | Bruncker | |
| 2,978,040 | A | 4/1961 | Wirkkala | |
| 4,080,099 | A * | 3/1978 | Snyder | 416/146 R |
| 4,331,429 | A | 5/1982 | Koepsel et al. | |
| 4,632,636 | A | 12/1986 | Smith | |
| 5,791,874 | A | 8/1998 | Lang | |
| 6,390,776 | B1 | 5/2002 | Gruenwald | |
| 6,467,422 | B1 * | 10/2002 | Elms | 114/274 |
| 6,699,016 | B1 | 3/2004 | Dean | |
| 7,144,223 | B2 | 12/2006 | Buzzi | |
| 2009/0010763 | A1 * | 1/2009 | Watts | 416/223 R |

* cited by examiner

*Primary Examiner* — Igor Kershteyn
(74) *Attorney, Agent, or Firm* — R. Keith Harrison

(57) ABSTRACT

A marine propeller with reverse thrust cup includes a propeller hub, propeller blades each having a leading blade face and a trailing blade face provided on the propeller hub and a reverse thrust cup provided in the trailing blade face of each of the propeller blades.

16 Claims, 4 Drawing Sheets

MARINE PROPELLER WITH REVERSE THRUST CUP

CROSS-REFERENCE TO RELATED APPLICATIONS

This application claims the benefit of and incorporates by reference in its entirety U.S. provisional application No. 61/279,082, filed Oct. 16, 2009 and entitled "MARINE PROPELLER WITH REVERSE THRUST CUP".

FIELD

The present disclosure relates to marine propellers. More particularly, the present disclosure relates to a marine propeller having a reverse thrust cup provided in each blade of the propeller to minimize cavitation and enhance the reverse thrust capability of the propeller.

BACKGROUND

Recreational marine vehicles such as speedboats, ski boats, fishing boats, houseboats and the like commonly have a motor-driven drive system which includes a multi-bladed marine propeller. The propeller typically includes a hub from which extends multiple, spaced-apart propeller blades each having a leading face and a trailing face which is opposite the leading face. Each blade is oriented at an angle with respect to the rotational axis of the hub. Therefore, when the propeller is submerged in a lake or other water body on which the marine vehicle floats and is rotated in a first direction, the leading face of each propeller blade applies rearward pressure against the water, propelling the marine vehicle forwardly on the water body. Conversely, when the propeller is rotated in a second direction, the trailing face of each propeller blade applies forward pressure against the water, propelling the marine vehicle rearwardly on the water body.

One of the problems which is frequently encountered in operating a marine vehicle in reverse results from cavitation of the water at the trailing face of each blade on the propeller. As the submerged propeller is rotated in water, the water accelerates around the edges of each blade, causing a reduction in water pressure at the trailing face of the blade until the pressure of the water eventually reaches the vapor pressure of the water. Consequently, cavitation occurs at the trailing face of the blade as the water vaporizes and small bubbles of air form in the water. Cavitation of the water at the trailing face of each blade when the vehicle is operated in reverse typically results in vibration of the propeller and may compromise the reverse thrust capability of the marine vehicle.

Therefore, a marine propeller having a reverse thrust cup provided in each blade of the propeller to minimize cavitation and enhance the reverse thrust capability of the propeller is needed.

SUMMARY

The present disclosure is generally directed to a marine propeller. An illustrative embodiment of the marine propeller includes a propeller hub, propeller blades each having a leading blade face and a trailing blade face provided on the propeller hub and a reverse thrust cup provided in the trailing blade face of each of the propeller blades.

BRIEF DESCRIPTION OF THE DRAWINGS

The disclosure will now be made, by way of example, with reference to the accompanying drawings, in which.

DETAILED DESCRIPTION

Figure 1:
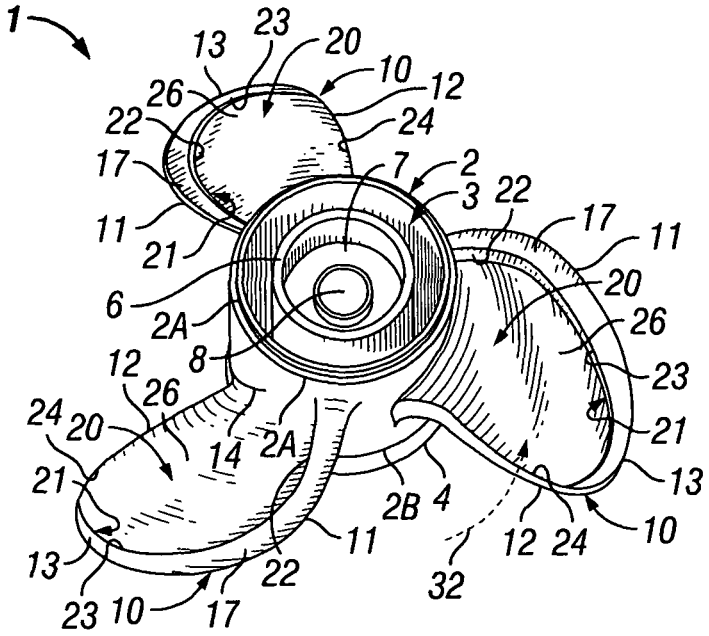
FIG. 1 is a rear perspective view of an illustrative embodiment of the marine propeller with reverse thrust cup.

The following detailed description is merely exemplary in nature and is not intended to limit the described embodiments or the application and uses of the described embodiments. As used herein, the word "exemplary" or "illustrative" means "serving as an example, instance, or illustration." All of the implementations described below are exemplary implementations provided to enable persons skilled in the art to practice the disclosure and are not intended to limit the scope of the claims. Furthermore, there is no intention to be bound by any expressed or implied theory presented in the preceding technical field, background, brief summary or the following detailed description. As used herein, relative terms such as "fore" and "aft" are used for descriptive purposes only and not in a limiting sense.

Referring to the drawings, an illustrative embodiment of the marine propeller with reverse thrust cup, hereinafter propeller, is generally indicated by reference numeral 1. The propeller 1 includes a generally elongated, cylindrical propeller huh 2 which may have a hub interior 3. In some embodiments, a shaft sleeve 6 may be provided in the hub interior 3. A shaft bearing 7 may be provided in the shaft sleeve 6. In use of the propeller 1, which will be hereinafter described, the shaft bearing 7 may receive a propeller drive shaft 8 that is drivingly engaged by a marine engine (not illustrated) provided on a marine vehicle (not illustrated). The shaft bearing 7 may be coupled to the propeller drive shaft 8 in any suitable manner according to the knowledge of those skilled in the art. In some embodiments, the shaft bearing 7 may be coupled to the propeller drive shaft 8 using a splined coupling (not illustrated) as is well known by those skilled in the art. The propeller hub 2 may have a fore hub end 2*a* which generally faces the marine vehicle (not illustrated) and an aft hub end 2*b* which generally faces away from the marine vehicle (not illustrated). A diffuser lip 4 may flare outwardly from the aft hub end 2*b* of the propeller hub 2 to reduce cavitation, as is known by those skilled in the art.

Multiple propeller blades 10 extend radially or outwardly from the propeller hub 2 in spaced-apart relationship with respect to each other around the circumference of the propeller hub 2. Each propeller blade 10 may be attached to the propeller hub 2 along a blade/hub junction 14 which is disposed at a selected angle with respect to a rotational axis 5 (FIG. 3) of the propeller hub 2. Each propeller blade 10 may have a generally curved outline, with a leading blade edge 11 which may be generally proximate to the fore hub end 2*a*; a trailing blade edge 12 which may be generally proximate to the aft hub end 2*b*; and an outer blade edge 13 which transitions the leading blade edge 11 to the trailing blade edge 12. Each propeller blade 10 has a leading blade face 16 which may generally face the aft hub end 2*b* of the propeller hub 2 and a trailing blade face 17 which may generally face the fore hub end 2*a* of the propeller hub 2. In use of the propeller 1, which will be hereinafter described, the leading blade edge 11 and the leading blade face 16 of each propeller blade 10 rotate ahead of the trailing blade edge 12 and the trailing blade face 17, respectively, of each propeller blade 10 when the marine vehicle (not illustrated) on which the propeller 1 is provided is operated in the forward direction on a water body (not illustrated). Conversely, the trailing blade edge 12 and the trailing blade face 17 of each propeller blade 10 rotate ahead of the leading blade edge 11 and the leading blade face 16, respectively, of each propeller blade 10 when the marine vehicle is operated in the reverse direction on the water body.

Figure 4:
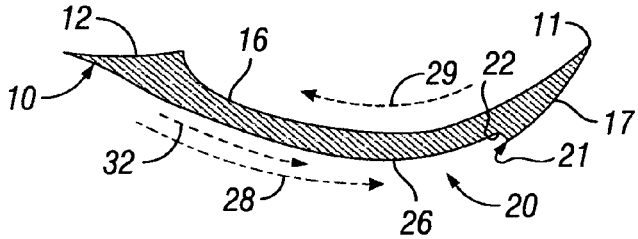
FIG. 4 is a sectional view, taken along section lines 4-4 in FIG. 3, of a propeller blade of an illustrative embodiment of the marine propeller with reverse thrust cup.
Figure 5:
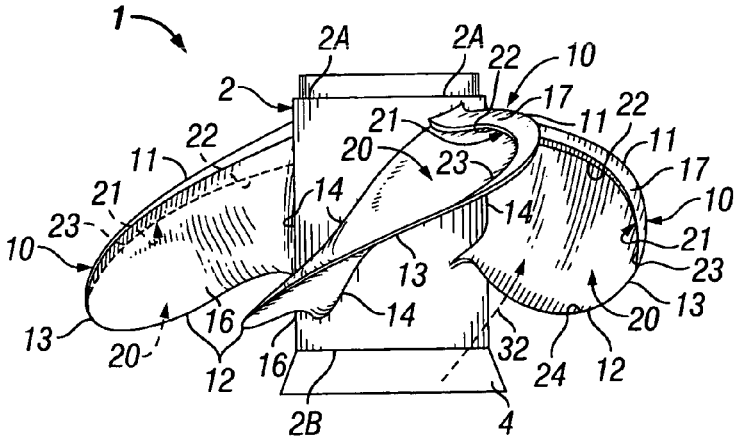
FIG. 5 is a side view of an illustrative embodiment of the marine propeller with reverse thrust cup, taken along viewing lines 5-5 in FIG. 2.

As illustrated in FIG. 4, the trailing blade face 17 may be generally convex whereas the leading blade face 16 of each propeller blade 10 may be generally concave in cross-section. A reverse thrust cup 20 having a generally convex cup surface 26 is provided in the trailing blade face 17 of each propeller blade 10. The reverse thrust cup 20 may be cast, stamped, cut or otherwise provided in the trailing blade face 17 according to the knowledge of those skilled in the art.

Figure 3:
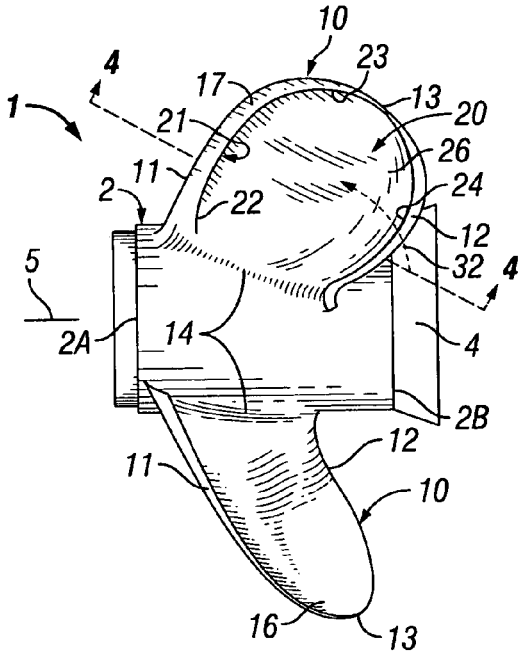
FIG. 3 is a side view of an illustrative embodiment of the marine propeller with reverse thrust cup, taken along viewing lines 3-3 in FIG. 2.

As illustrated in FIGS. 1 and 3, the reverse thrust cup 20 in each propeller blade 10 may have a curved cup lip 21 which defines a boundary between the cup surface 26 of the reverse thrust cup 20 and the remaining surface of the trailing blade face 17. In some embodiments, the cup lip 21 may include a curved radial lip portion 22 which is oriented in generally radial relationship with respect to the propeller hub 2 and extends generally from the blade/hub junction 14 in generally parallel and spaced-apart relationship with respect to the leading blade edge 11 of the propeller blade 10. A curved outer lip portion 23 may continue the radial lip portion 22 of the cup lip 21 in generally spaced-apart relationship with respect to the outer blade edge 13 of the propeller blade 10. The outer lip portion 23 may terminate at the trailing blade edge 12 of the propeller blade 10. A trailing cup edge 24 may define the trailing boundary of the reverse thrust cup 20 and may extend generally from the end of the outer lip portion 23 toward the blade/hub junction 14 of the propeller blade 10. The trailing cup edge 24 may generally coincide with the trailing blade edge 12 of the propeller blade 10.

In typical application, the propeller 1 is coupled to a propeller drive shaft 8 which is drivingly engaged by a marine engine (not illustrated) provided on a marine vehicle (not illustrated). Accordingly, the shaft bearing 7 provided in the propeller hub 2 of the propeller 1 receives the propeller drive shaft 8, with the fore hub end 2*a* of the propeller hub 2 generally facing toward the marine vehicle and the aft hub end 2*b* of the propeller hub 2 generally facing away from the marine vehicle. The shaft bearing 7 may be coupled to the propeller drive shaft 8 according to any suitable attachment technique which is known by those skilled in the art.

As the marine vehicle is placed on a lake or other water body (not illustrated), the propeller 1 is submerged in the water body. In forward operation of the marine vehicle on the water body, the propeller drive shaft 8 rotates the propeller 1 in the clockwise direction illustrated in FIG. 2, as indicated by the forward rotation arrow 28, such that the leading blade face 16 of each propeller blade 10 applies rearward pressure against the water in the water body. Consequently, the water pushes forwardly against each propeller blade 10, propelling the marine vehicle forwardly on the water body typically in the conventional manner.

Figure 2:
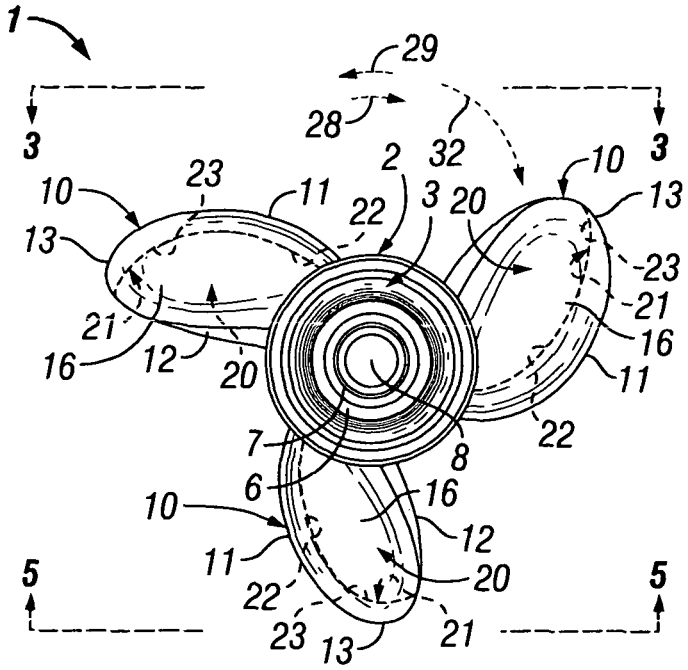
FIG. 2 is a front view of an illustrative embodiment of the marine propeller with reverse thrust cup.

In rearward operation of the marine vehicle on the water body, the propeller drive shaft 8 rotates the propeller 1 in the counterclockwise direction illustrated in FIG. 2, as indicated by the reverse rotation arrow 29. Therefore, the trailing blade face 17 of each propeller blade 10 applies forward pressure against the water in the water body. Consequently, the water pushes rearwardly against each propeller blade 10, propelling the marine vehicle rearwardly on the water body.

As illustrated in FIG. 4, throughout reverse rotation of the propeller 1, as indicated by the reverse rotation arrow 29, the trailing blade edge 12 of each propeller blade 10 presents a gentle angle of attack to the water 32 in the water body, minimizing cavitation and drag on the propeller 1. Water 32 in the water body initially traverses the trailing blade edge 12 of each propeller blade 10 and then flows across the cup surface 26 and then strikes the cup lip 21 of the reverse thrust cup 20. It will be appreciated by those skilled in the art that the cup lip 21 deflects the trajectory of the water 32 away from the propeller blade 10. Consequently, cavitation of the water 32 at the reverse thrust cup 20 is eliminated or substantially reduced, enhancing the reverse thrust of the marine vehicle as well as enabling the operator of the marine vehicle to more precisely control the reverse speed of the marine vehicle on the water body.

It will be appreciated by those skilled in the art that the propeller with reverse thrust cup 1 may be manufactured using any of the metalworking, casting or other known or yet to be developed marine propeller fabrication methods. The propeller 1 may be constructed of any suitable material which is used to fabricate marine propellers including aluminum, bronze, stainless steel and composite materials, for example and without limitation. The reverse thrust cup 20 may be cast into the trailing blade face 17 of each propeller blade 10 or may be provided in the trailing blade face 17 using cutting, stamping, machining or other suitable techniques known by those skilled in the art. Moreover, the propeller 1 is suitable for enhancing the reverse thrust capability of a variety of marine vehicles including speedboats, ski boats, fishing boats and houseboats, for example and without limitation, and may be applicable to any type of marine engine including inboard engines, outboard engines or inboard/outboard engines, for example and without limitation. Additionally, many outboard and sterndrive propellers discharge exhaust gas through the open sections of the hub interior 3. In forward operation, these gases are discharged behind the propeller blades 10 and in most cases have little effect on forward thrust. However, in reverse operation, these exhaust gases are being discharged directly into the path of the propeller blades 10, producing a gaseous aeration of the water. In such operations, the reverse thrust cup 20 helps greatly in controlling slippage between the propeller blades 10 and the water due to the described aeration.

Figure 6:
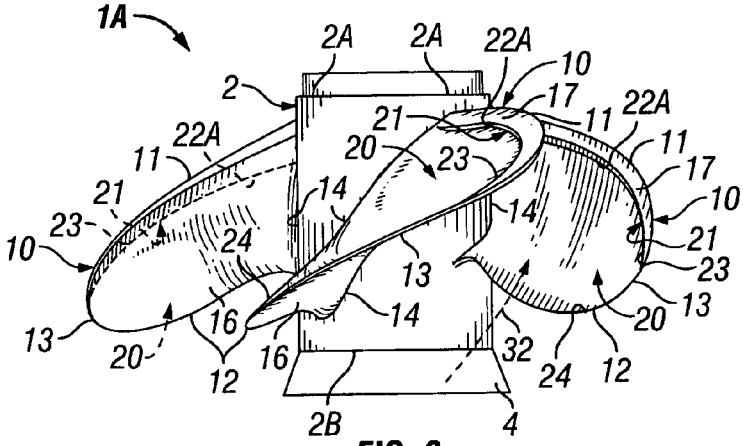
FIG. 6 is a side view of an alternative illustrative embodiment of the marine propeller with reverse thrust cup, with a propeller blade illustrated in edge view.
Figure 7:
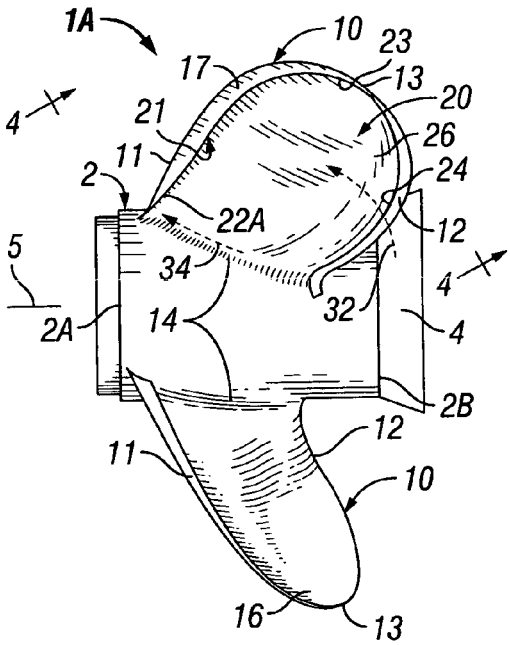
FIG. 7 is a side view of the alternative illustrative embodiment of the marine propeller with reverse thrust cup illustrated in FIG. 6, with a propeller blade illustrated in rear view.
Figure 8:
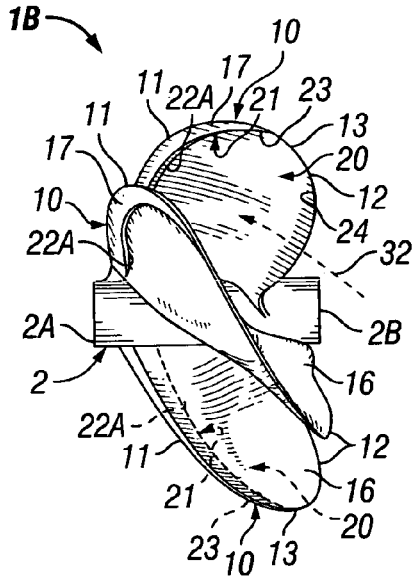
FIG. 8 is a side view of an illustrative embodiment of an inboard marine propeller with reverse thrust cup, with a propeller blade illustrated in edge view.

Referring next to FIGS. 6-8 of the drawings, an alternative illustrative embodiment of the marine propeller with reverse thrust cup is generally indicated by reference numeral 1*a* in FIGS. 6 and 7. The propeller 1*a* may have a design which is similar to that of the propeller 1 which was heretofore described with respect to FIGS. 1-5. In the propeller 1*a*, the cup lip 21 may have a tapered radial lip portion 22*a* the thickness of which gradually tapers toward the blade/hub junction 14. Accordingly, as illustrated in FIG. 7, a water flow path 34 is defined between the tapered radial lip portion 22*a* and the blade/hub junction 14. The water flow path 34 provides a substantially unhindered path for flow of water as the propeller 1*a* is operated in reverse. An inboard marine propeller 1*b* having a tapered radial lip portion 22*a* is illustrated in FIG. 8.

Figure 9:
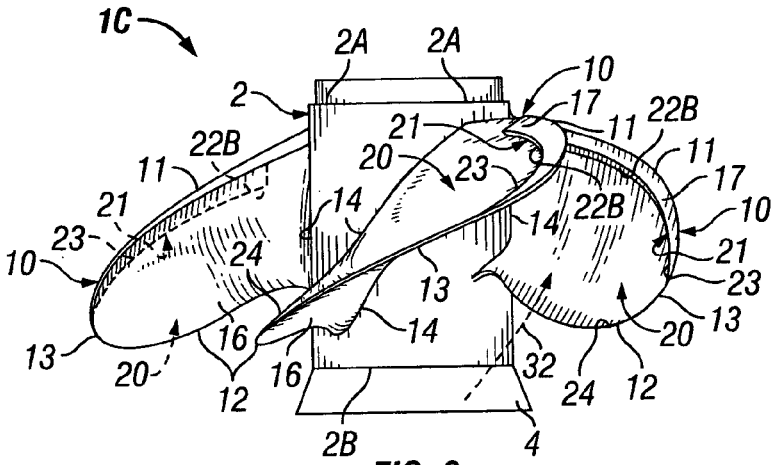
FIG. 9 is a side view of another alternative illustrative embodiment of an inboard marine propeller with reverse thrust cup, with a propeller blade illustrated in edge view.
Figure 10:
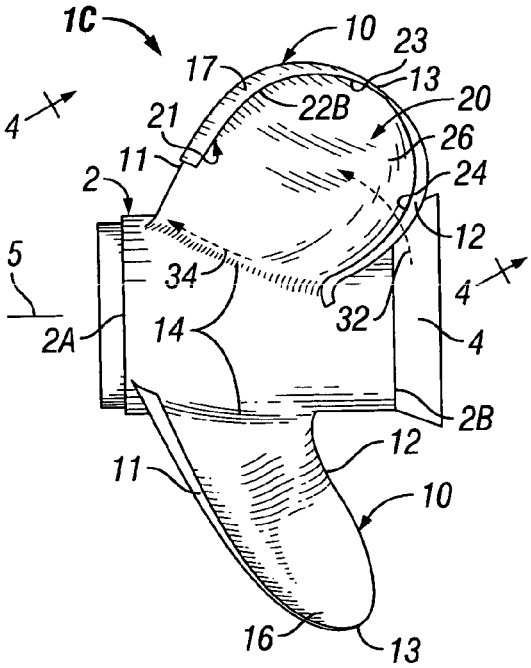
FIG. 10 is side view of the illustrative inboard marine propeller with reverse thrust cup illustrated in FIG. 9.
Figure 11:
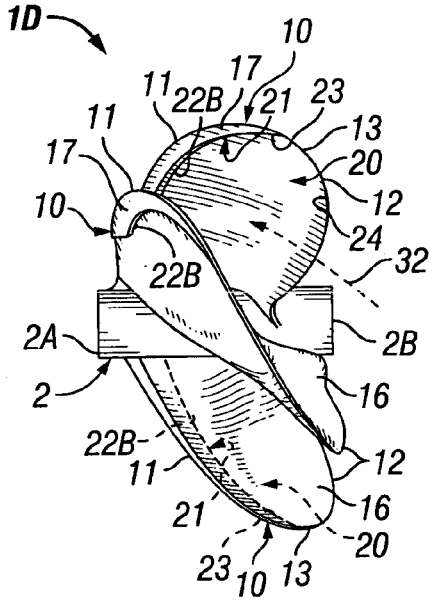
FIG. 11 is side view of yet another alternative embodiment of an inboard marine propeller with reverse thrust cup, with a propeller blade illustrated in edge view.

Referring next to FIGS. 9-11 of the drawings, another alternative illustrative embodiment of the marine propeller with reverse thrust cup is generally indicated by reference numeral 1*c* in FIGS. 9 and 10. The propeller 1*c* may have a design which is similar to that of the propeller 1 which was heretofore described with respect to FIGS. 1-5. In the propeller 1*c*, the cup lip 21 may have a truncated radial lip portion 22*b* which terminates in spaced-apart relationship to the blade/hub junction 14. Accordingly, as illustrated in FIG. 10, a water flow path 34 is defined between the truncated radial lip portion 22*b* and the blade/hub junction 14. The water flow path 34 provides a substantially unhindered path for flow of water as the propeller 1*c* is operated in reverse. An inboard marine propeller 1*d* having a truncated radial lip portion 22*b* is illustrated in FIG. 11.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. A marine propeller, comprising:

a propeller hub;

a plurality of propeller blades each having a leading blade face, a trailing blade face and a leading blade edge, an outer blade edge and a trailing blade edge carried by said propeller hub;

a reverse thrust cup provided in said trailing blade face of each of said plurality of propeller blades, the reverse thrust cup having a cup lip provided in said trailing blade face and said cup lip including:

a radial lip portion extending generally radially with respect to said propeller hub; and an outer lip portion extending from said radial lip portion and along said outer blade edge to said trailing blade edge of each of said plurality of propeller blades.

2. The marine propeller of claim 1 further comprising a generally convex cup surface extending from said cup lip.

3. The marine propeller of claim 1 further comprising a trailing cup edge extending from said outer lip portion.

4. The marine propeller of claim 1 further comprising a water flow path between said radial lip portion of said cup lip and said propeller hub.

5. The marine propeller of claim 4 wherein said radial lip portion comprises a tapered radial lip portion.

6. The marine propeller of claim 4 wherein said radial lip portion comprises a truncated radial lip portion.

7. A marine propeller, comprising:

a propeller hub;

a plurality of propeller blades each having a leading blade face, a trailing blade face, a leading blade edge, an outer blade edge and a trailing blade edge carried by said propeller hub; and a reverse thrust cup provided in said trailing blade face of each of said plurality of propeller blades and bounded by said outer blade edge and said trailing blade edge, the reverse thrust cup having a cup lip provided in said trailing blade face and said cup lip including:

a radial lip portion extending generally radially with respect to said propeller hub; and an outer lip portion extending from said radial lip portion and along said outer blade edge to said trailing blade edge of each of said plurality of propeller blades.

8. The marine propeller of claim 7 further comprising a generally convex cup surface extending from said cup lip.

9. The marine propeller of claim 7, further comprising a trailing cup edge extending from said outer lip portion.

10. The marine propeller of claim 7 further comprising a water flow path between said radial lip portion of said cup lip and said propeller hub.

11. The marine propeller of claim 10 wherein said radial lip portion comprises a tapered radial lip portion.

12. The marine propeller of claim 10 wherein said radial lip portion comprises a truncated radial lip portion.

13. A marine propeller, comprising:

a propeller hub;

a plurality of propeller blades each having a leading blade face, a trailing blade face, a leading blade edge, an outer blade edge and a trailing blade edge carried by said propeller hub; and a reverse thrust cup provided in said trailing blade face of each of said plurality of propeller blades; and wherein said reverse thrust cup includes a cup lip having a radial lip portion generally parallel and spaced-apart with respect to said leading blade edge and an outer lip portion generally spaced-apart with respect to the outer blade edge, and said reverse thrust cup is bounded by said cup lip, said outer blade edge and said trailing blade edge.

14. The marine propeller of claim 13 further comprising a water flow path between said radial lip portion of said cup lip and said propeller hub.

15. The marine propeller of claim 14 wherein said radial lip portion comprises a tapered radial lip portion.

16. The marine propeller of claim 14 wherein said radial lip portion comprises a truncated radial lip portion.

* * * * *